US005490326A

United States Patent [19]

Nielson

[11] Patent Number: 5,490,326

[45] Date of Patent: Feb. 13, 1996

[54] METHOD OF RETROFITTING FLUORESCENT LIGHT FIXTURES AND PUNCH AND DIE ASSEMBLY THEREFOR

[76] Inventor: Lyman O. Nielson, 2183 Window Pl., St. George, Utah 84770

[21] Appl. No.: 203,940

[22] Filed: Mar. 1, 1994

[51] Int. Cl.[6] ..... H01R 43/00; B21B 15/00

[52] U.S. Cl. ..... 29/876; 29/33 M; 83/49; 83/50; 83/693; 83/917; 445/1; 445/2; 445/26; 445/60

[58] Field of Search ..... 83/49, 50, 692, 83/693, 917; 445/1, 2, 22, 26, 60, 61; 29/876

[56] References Cited

U.S. PATENT DOCUMENTS 4,072,076 2/1978 Miles .

FOREIGN PATENT DOCUMENTS

89/7735 8/1989 WIPO .

OTHER PUBLICATIONS

Sheet Metal Industries Jan. 1973 pp. 27–31 by Whitton.

*Primary Examiner*—Carl J. Arbes

*Attorney, Agent, or Firm*—Mallinckrodt & Mallinckrodt

[57] ABSTRACT

So-called "retrofitting" of old style fluorescent lighting fixtures is carried out in a punch and die press provided with a special punch and die assembly having guide blocks positioned laterally of the punch and die for receiving pre-existing notches flanking the unnotched portion of the notched edge margin of a so-called "trougher raceway" strip portion of the old fluorescent lighting feature to be retrofitted, the punch of which assembly has cutting edges configurated for piercing the metal work strip backwardly of the notched edge thereof and at the ends of a longitudinal cut to be made and at the back ends of mutually spaced lateral end cuts to be made and for executing severing stokes along such cutting edges and thereby cutting out and removing a slug of metal exactly conforming in shape and dimension to the pre-existing guide notches.

5 Claims, 2 Drawing Sheets

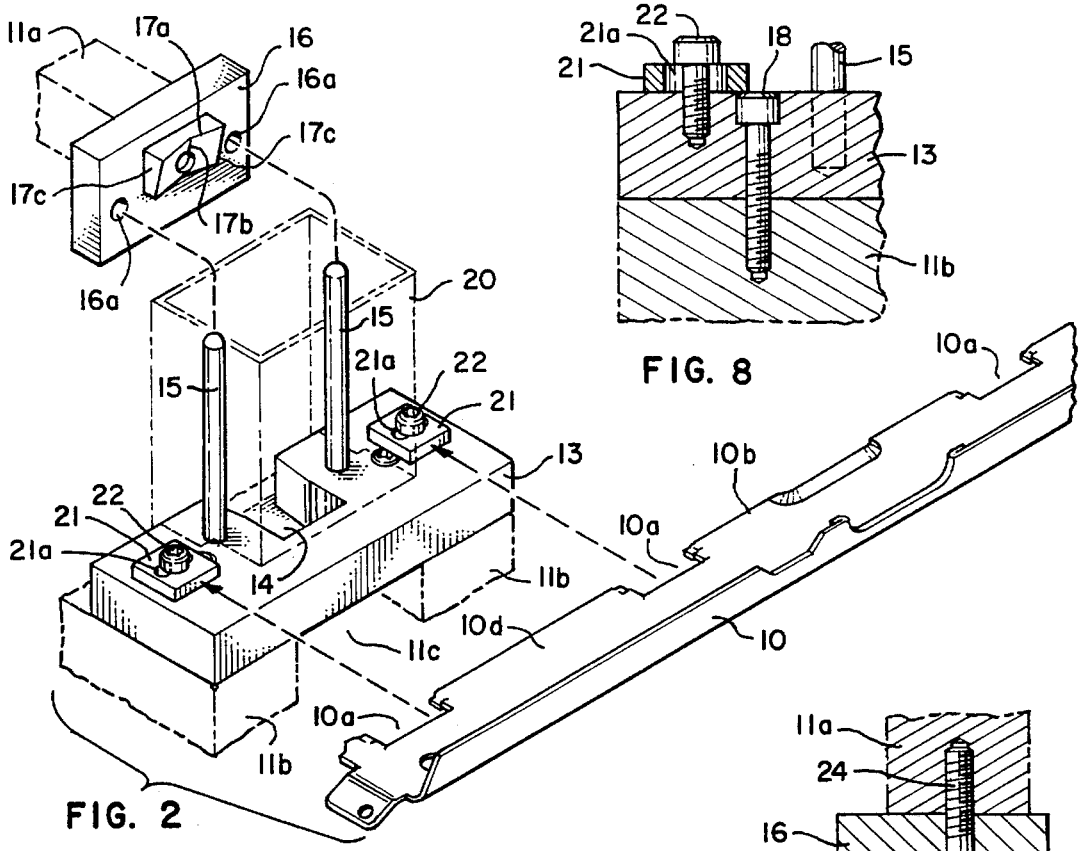
FIG. 2
FIG. 8
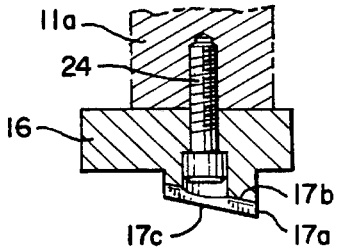
FIG. 7
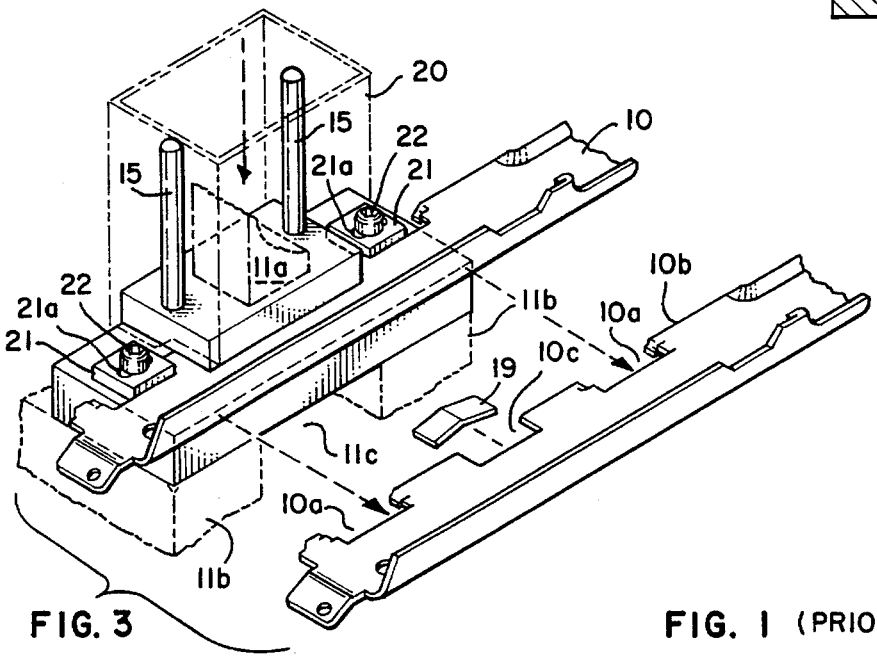
FIG. 3
FIG. 1 (PRIOR ART)
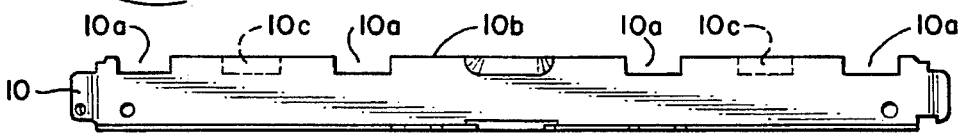

METHOD OF RETROFITTING FLUORESCENT LIGHT FIXTURES AND PUNCH AND DIE ASSEMBLY THEREFOR

BACKGROUND OF THE INVENTION

1. Field

The invention has to do with what has become known in the fluorescent lighting industry as "retrofitting" existing fluorescent light fixtures to accept new lower wattage fluorescent tubes that give more light at less expense.

2. State of the Art

Such retrofitting of old style fluorescent lighting fixtures from the many extensive installations of same in office buildings and commercial establishments has taken place more slowly than might have been expected due to the difficulty of carrying out such retrofitting in practice. As commonly done, the new notches required for installation of replacement electrical sockets (often spoken of by electricians on the job as "tombstones") in the so-called "trougher raceways" of the existing fluorescent light fixtures requires tedious cutting and fitting after precise measurements are made.

The principal objective in the making of the present invention, involving both method and apparatus, was to enable retrofitting to be carried out quickly and easily and to so make such retrofitting economically attractive.

SUMMARY OF THE INVENTION

The method of the invention as conceived by me involves the use of a specially designed and constructed punch and die assembly for installation in a desirably portable punch and die press, of either manually or power operated type. Such assembly comprises a punch of rectangular shape configurated for initial penetration of the metal strip concerned at opposite ends of the backward longitudinal edge portion thereof followed by progressive severing both longitudinally and forwardly along laterally placed ends of the new notch to be formed up to intersection with the pre-existing notched edge of such metal strip that is forwardly placed in the punch and die press, thereby releasing and bending, transversely of its length, a slug of metal to be removed in the forming of the required notch.

Important in the carrying out of the method is provision for quickly and easily placing the punch and die of the assembly of same precisely with respect to the location of the new edge notch to be formed. This is accomplished by providing the punch and die assembly with guide means that are set, or can be set, by the user to fit exactly into pre-existing notches in the notched edge of the strip that are positioned laterally of the unnotched portion of such pre-existing notched edge that is to be notched for the purpose of the retrofitting operation. In this way, the punch and die press can be set up right on the job for immediately carrying out the numerous punchings of required new edge notches from old fluorescent fixtures to be retrofitted in an extensive installation of the old type of fluorescent lighting fixtures.

As is usual in many punch and die presses, the punched-out slugs fall by gravity into a container placed under the die. In the present instance, release of the slug from the punched strip is facilitated by its being bent upwardly and pushed into a receiving recess in the punch by the punching operation itself, from where it promptly falls by gravity into the container below.

THE DRAWINGS

Illustrated in the accompanying drawings are a punch and die assembly and a press constituting what is presently contemplated as the best mode of carrying out the invention in actual practice.

In the drawings:

FIG. 1 represents a top plan view of a typical old style, pre-notched edge strip as removed from the so-called "trougher raceway" of an old style fluorescent lighting fixture to be "retrofitted";

FIG. 2, an exploded pictorial view, showing the strip of FIG. 1 ready to be inserted into the punch and die assembly of a manually operated arbor press of conventional type modified as required by the invention and partially indicated fragmentarily by broken lines, the view being drawn to a somewhat larger scale than FIG. 1;

FIG. 3, a view somewhat similar to that of FIG. 2 showing the punch fragmentarily and in its position at the termination of a punching stroke in the punching of a new edge notch in the strip of FIGS. 1 and 2, which strip is shown both within the press and how it appears when taken out of the press, the punched-out slug being shown for purposes of illustration in position immediately in front of the new notch in the showing of the work strip as removed from the press;

FIG. 4, a side elevation of the arbor press, punch and die assembly, and work strip in position to be punched, the press being indicated by broken lines and the press plunger and punch raised ready for a punching stroke;

FIG. 5, a fragmentary front elevation taken on the line 5—5 of FIG. 4, portions of the work strip being broken out to reveal the work placement guide members of the press;

FIG. 6, a fragmentary vertical section taken on the line 6—6 of FIG. 4 but with press plunger and punch at bottom of the punching stroke and the punched-out slug descending toward its catch container, which is not shown;

FIG. 7, a fragmentary vertical section taken on the line 7—7 of FIG. 5; and FIG. 8, a fragmentary vertical section taken on the line 8—8 of FIG. 4.

DETAILED DESCRIPTION OF THE ILLUSTRATED EMBODIMENT

In the usual retrofitting of old fluorescent lighting fixtures, the notched edge margins of pre-existing, trougher raceway strips are provided with corresponding notches at previously unnotched locations for receiving new electrical sockets or so-called "tombstones". These new notches are laboriously provided by cutting and fitting.

Figure 6:
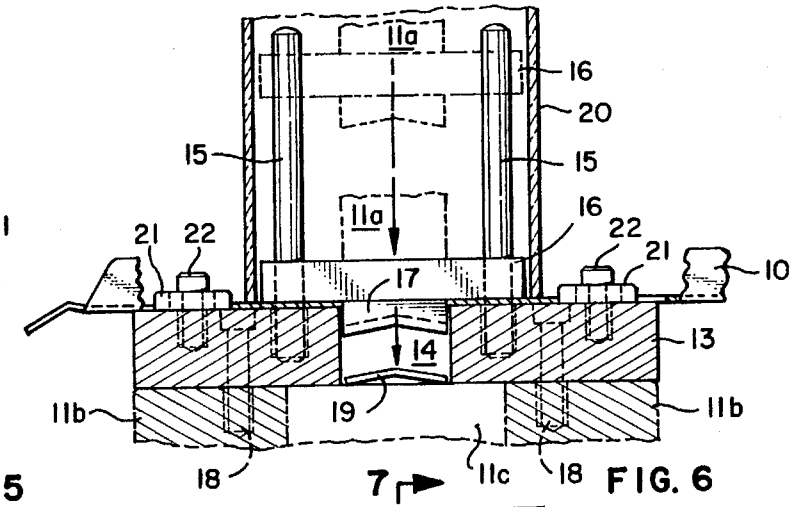

In accordance with the invention, a "trougher raceway" strip 10 of an old fluorescent light fixture to be "retrofitted" is introduced into the punch and die assembly of a conventional punch and die press (shown in phantom), which is desirably portable, e.g. mounted on wheels (not shown) so it can be easily moved from place to place as required during the retrofitting of the many fluorescent light fixtures making up the extensive lighting installations in large buildings and other large areas. Such a press can be manually operated, as is the conventional arbor press 11 partially illustrated in FIG. 4, or can be power operated. Either way, the invention provides a punch and die assembly for installation in such a press so as to accept an existing strip 10, pre-notched at **10*a* along its longitudinal edge 10*b* as the work strip, for punching out the required new notch or notches 10*c*, indicated by broken lines in FIG. 1 and shown in FIGS. 3 and 6** as having been punched out.

Figure 5:
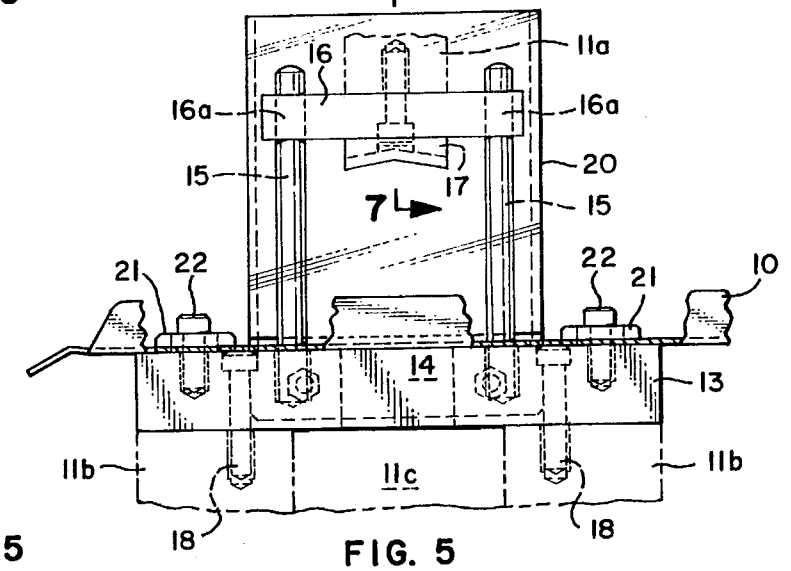

The punch and die assembly as here illustrated comprises a die shoe 12, FIG. 1, made up of an elongate die plate 13 having a die recess 14 intermediate its ends (intermediate in the sense of being between the ends of such plate and not necessarily in the middle thereof) and a pair of upstanding posts 15, respectively, upstanding from securement in die plate 13 for receiving corresponding slideway passages 16*a*, respectively, FIG. 2, of a punch carrier plate 16 and thereby guiding up and down strokes of a punch 17 that is carried by such punch plate 16 as fastened to the lower end of a plunger 11*a* of press 11, see FIG. 7. The die shoe is fastened to bed 11*b* of press 11 as by bolts 18, respectively, FIGS. 5 and 6, passing through die plate 13 and into the press bed. Such bed is provided with a passage 11*c* for receiving a container (not shown) that will catch slugs 19, FIG. 3, punched from a work strip 10 and falling through passage 11*c* by gravity. It is usual that an open-ended casing 20, here indicated as transparent, be secured to die plate 13 and be upstanding therefrom as part of die shoe 12 for protectively receiving the lower end portion of press plunger 11*a*, FIG. 4, which carries punch carrier plate 16 and punch 17.

Positioned laterally of die recess 14 are guide means, here shown in the form of a pair of guide blocks 21, respectively, see especially FIGS. 2 and 3, for receiving the old notches 10*a*, respectively, pre-existing along notched edge 10*b* of the trougher raceway strip 10 that is concerned in any operation of the press 11. Such pre-existing notches 10*a* are normally at opposite ends of an as yet unnotched portion 10*d*, FIG. 2, of the strip 10 constituting the work to be introduced into the punch and die assembly. Guide blocks 21 are preferably adjustable in position longitudinally of die plate 13 by reason of being fastened to such die plate by respective Allen screws 22 passing through respective elongate slots 21*a* in guide blocks 21.

Figure 4:
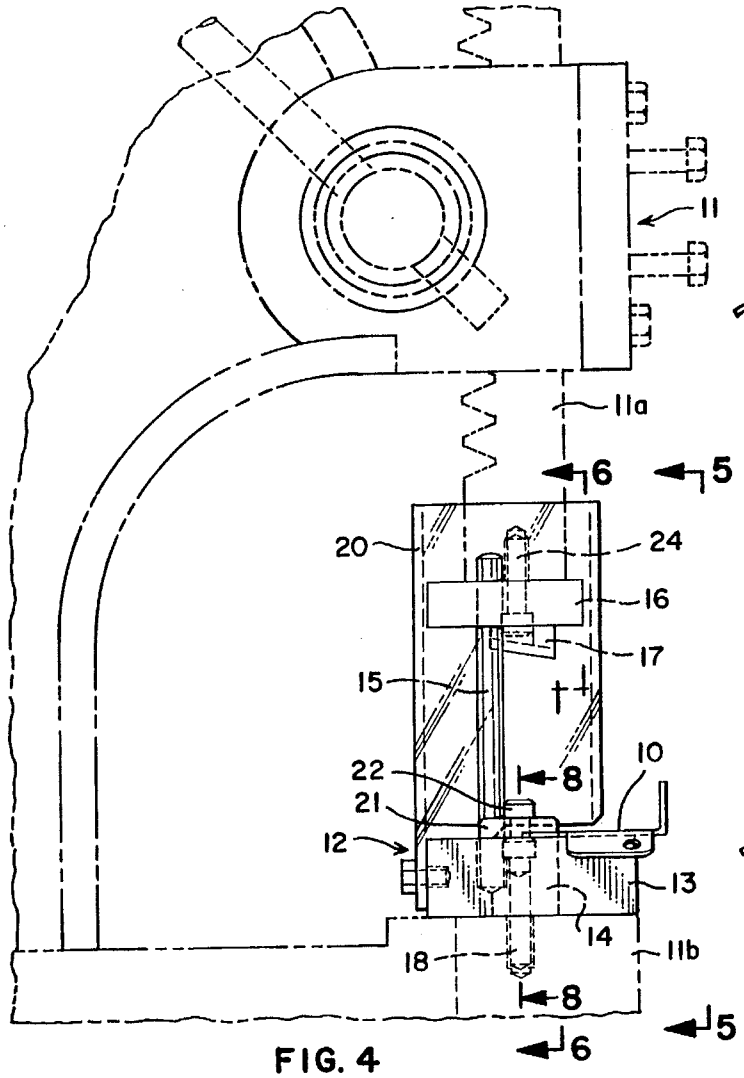

In using press 11 in accordance with the method of the invention, work strip 10 is inserted in the punch and die assembly 12 so as to extend longitudinally therewith, the notched edge 10*b* being foremost as shown in FIG. 3 and the punch 17 extending backwardly into the edge margin of the strip as can be seen from the showing in FIG. 4. Pre-existing notches 10*a* receive guide blocks 21, respectively, which are set in position on die plate 13 for this purpose.

Punch 15 has cutting edges positioned relative to one another to progressively cut out the new rectangular notch 10*c* along and opening into the notched edge 10*b* of a work strip 10, such new notch exactly conforming to the rectangular pre-existing notches 10*a* and positioned between guide blocks 21 as required.

For that purpose, the cutting edges of punch 17 include a back longitudinal edge 17*a*, FIG. 2, sloping upwardly along its length from opposite ends thereof to preferably provide the back end of a ridge line 17*b* extending from front to back of the punch along the center thereof, and further include lateral cutting edges 17*c*, respectively, at the ends of longitudinal edge 17*a* and extending forwardly and sloping progressively upwardly a sufficient distance to intersect and cut through the forwardly positioned edge 10*b* of the work strip 10. By reason of the progressively upward slope of both the longitudinal cutting edge 17*a* and of the lateral cutting edges 17*c* of punch 12, slug 19 is easily sliced out of the foward edge margin of work strip 10 by severing action of the punch to provide the required new notch 10*c*, FIG. 3.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A method of retrofitting fluorescent lighting fixtures for the installation of electrical sockets at locations along edge margins of trougher raceways of such fixtures previously not prepared to receive such electrical sockets, comprising inserting the previously notched edge margin of the trougher raceway concerned in a punch and die press equipped with a punch and die assembly capable of notching such edge margin and with work placement guide means arranged laterally of the punch and die components of said assembly so that said work placement guide means extend into existing notches of said edge margin of the trougher raceway concerned in abutting relationship with portions thereof that establish the proper setting for the punch and die components of said assembly in punching out a required new electrical socket-receiving notch in the trougher raceway concerned; and operating said punch and die press to punch out said required new notch in said trougher raceway concerned.

2. A method in accordance with claim 1, wherein the existing notches of the previously notched edge margin of the trougher raceway concerned are of rectangular configuration extending longitudinally along said edge margin, and the work placement guide means are respective blocks having surfaces that exactly fit into and conform to the right angle end surfaces of the corresponding existing notches, and wherein the said guide blocks are fitted into mutually opposite ends, respectively, of said existing notches whereby the new notch to be punched out of the previously notched edge margin of the trougher raceway concerned corresponds exactly with the said existing notches.

3. A punch and die assembly for use in a punch and die press for retrofitting fluorescent lighting fixtures to receive new electrical sockets at locations along notched edge margins of trougher raceways thereof previously not prepared to receive such electrical sockets, comprising cooperating punch and die components capable of notching such an edge margin; and work placement guide means arranged laterally of said components for fitting into existing notches of the edge margin of the trougher raceway concerned in respective positions therein that establish a proper setting for the punch and die components of the punch and die assembly in punching out the required new electrical-socket-receiving notch in the trougher raceway concerned.

4. A punch and die assembly in accordance with claim 3, wherein the work placement guide means comprise respective, positionably adjustable, guide blocks; and respective means for firmly securing the corresponding guide blocks to the die member of the punch and die assembly in adjusted positions within the corresponding existing notches of the edge margin of the trougher raceway concerned.

5. A punch and die assembly in accordance with claim 3, wherein the die is an elongate die plate having a punch-receiving die recess intermediate its length and between respective guide means which are spaced apart longitudinally of said die plate, the punch being of rectangular configuration extending longitudinally of said die plate, being upwardly recessed, and having a longitudinal upwardly recessed, back cutting edge extending between lateral end blade members that slope progressively upwardly and forwardly from opposite ends of said longitudinal cutting edge of the punch so as to exercise respective severing strokes on the work longitudinally thereof back from the notched edge thereof and forwardly from opposite ends of the longitudinal cut to and through said notched edge of the strip so that an upwardly bowed slug is released for dropping from the punch and die assembly by gravity at the termination of the punching stroke.

* * * * *